US006152547A

United States Patent [19]

Wang

[11] Patent Number: 6,152,547

[45] Date of Patent: Nov. 28, 2000

[54] WARDROBE DOOR STRUCTURE

[76] Inventor: Wen-Tsan Wang, P.O. Box 82-144, Taipei, Taiwan

[21] Appl. No.: 09/375,403

[22] Filed: Aug. 17, 1999

[51] Int. Cl.[7] ..... E04H 1/12

[52] U.S. Cl. ..... 312/3; 312/297

[58] Field of Search ..... 312/3, 4, 5, 6, 312/297, 304; 135/115, 117, 119; 160/327, 330, 123, 126; 150/158, 154

[56] References Cited

U.S. PATENT DOCUMENTS

| | | | |
|---|---|---|---|
| 180,480 | 8/1876 | Klobassa | 312/3 |
| 3,066,995 | 12/1962 | Derman | 312/297 |

FOREIGN PATENT DOCUMENTS

| | | | |
|---|---|---|---|
| 477703 | 10/1951 | Canada | 312/4 |
| 2421127 | 11/1975 | Germany | 312/297 |

*Primary Examiner*—Janet M. Wilkens
*Attorney, Agent, or Firm*—A & J

[57] ABSTRACT

A wardrobe door structure, which includes a fixed horizontal top rail, a fixed horizontal bottom rail, and a sliding folding door, the sliding folding door having a horizontal top side edge, a horizontal bottom side edge, a first vertical side edge fixedly connected to a wardrobe, a second vertical side edge, a first set of loops arranged along the horizontal top side edge and respectively hung on the horizontal top rail, a second set of loops arranged along the horizontal bottom side edge and respectively hung on the horizontal bottom rail, and a vertical rod member fixedly arranged along the second vertical side edge for pulling by hand to move the sliding folding door horizontally along the horizontal top rail and the horizontal bottom rail between the close position and the open position.

1 Claim, 4 Drawing Sheets

WARDROBE DOOR STRUCTURE

BACKGROUND OF THE INVENTION

The present invention relates to wardrobes, and more specifically to a wardrobe door structure that can easily be opened/closed by sliding.

Regular economic, folding collapsible wardrobes are commonly comprised of a collapsible wardrobe covering, and a folding collapsible frame structure set up in the collapsible covering to support the collapsible wardrobe covering in shape. The collapsible wardrobe covering comprises a double-panel zipper-controlled door structure (see FIG. 4), or a single-panel zipper-controlled door structure (see FIG. 5). The door panel A is fastened to the collapsible wardrobe covering by zippers B. When opening the door, the zippers B must be unfastened one after another. When unfastening the vertical zipper, the user may have to sit on the heel. Therefore, it is inconvenient to close/open the door structure at the wardrobe covering.

SUMMARY OF THE INVENTION

It is one object of the present invention to provide a wardrobe door structure for a wardrobe, which can conveniently and quickly opened/closed by sliding. It is another object of the present invention to provide a wardrobe door structure, which can be made in the form of a double sliding door type door structure, or a single sliding door type door structure. According to one embodiment of the present invention, the wardrobe door structure comprises a fixed horizontal top rail, a fixed horizontal bottom rail, and a sliding folding door, the sliding folding door having a horizontal top side edge, a horizontal bottom side edge, a first vertical side edge fixedly connected to a wardrobe, a second vertical side edge, a first set of loops arranged along the horizontal top side edge and respectively hung on the horizontal top rail, a second set of loops arranged along the horizontal bottom side edge and respectively hung on the horizontal bottom rail, a vertical rod member fixedly arranged along the second vertical side edge for pulling by hand to move the sliding folding door horizontally along the horizontal top rail and the horizontal bottom rail between the close position and the open position, and a hand hole on the middle adjacent to the vertical rod member through which the hand is inserted to hold the vertical rod member and to pull the vertical rod member in opening/closing the sliding folding door.

DETAILED DESCRIPTION OF THE PREFERRED EMBODIMENT

Figure 1:
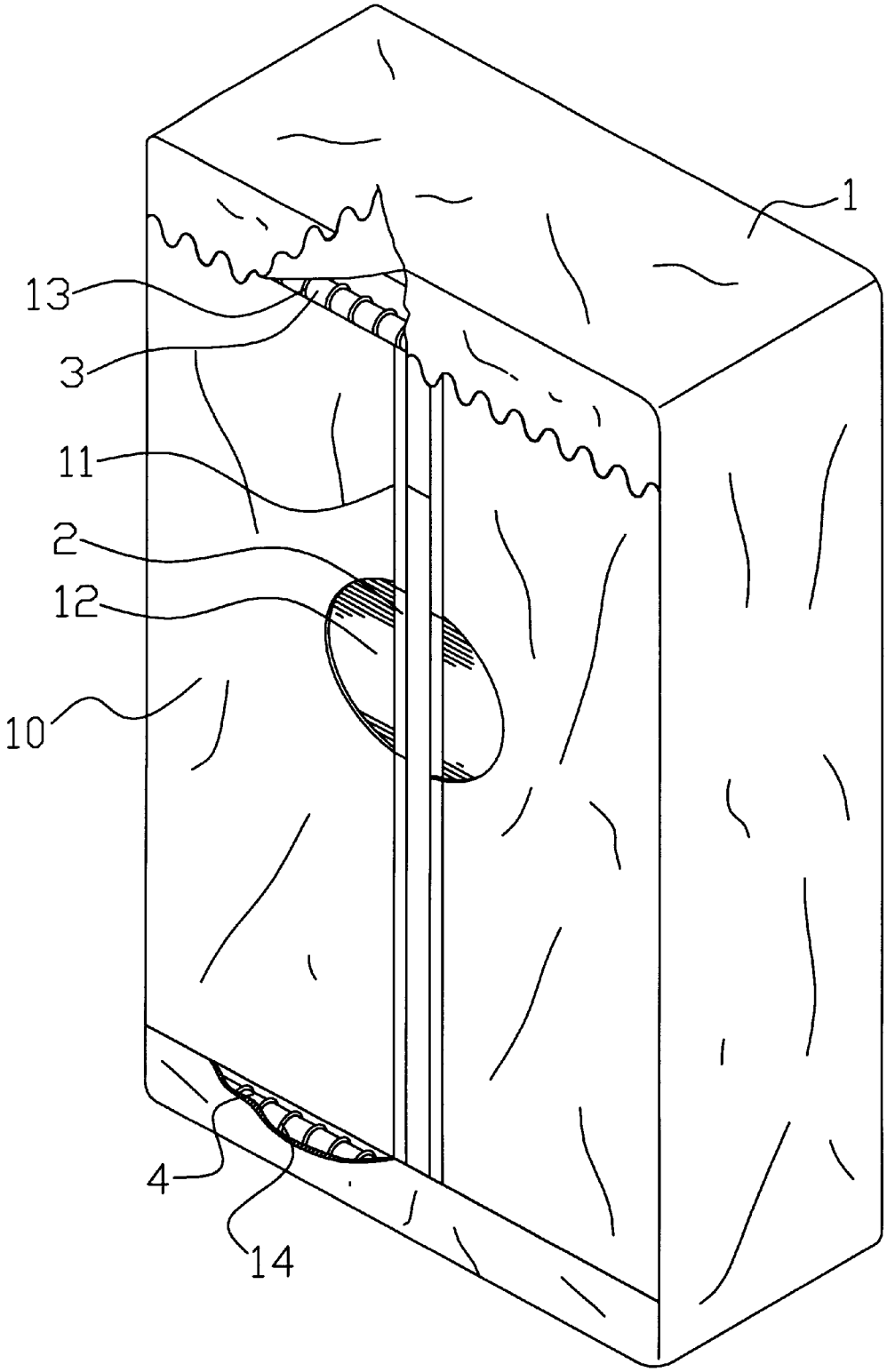
FIG. 1 is a perspective view of a wardrobe with two sliding folding doors according to the present invention.
Figure 2:
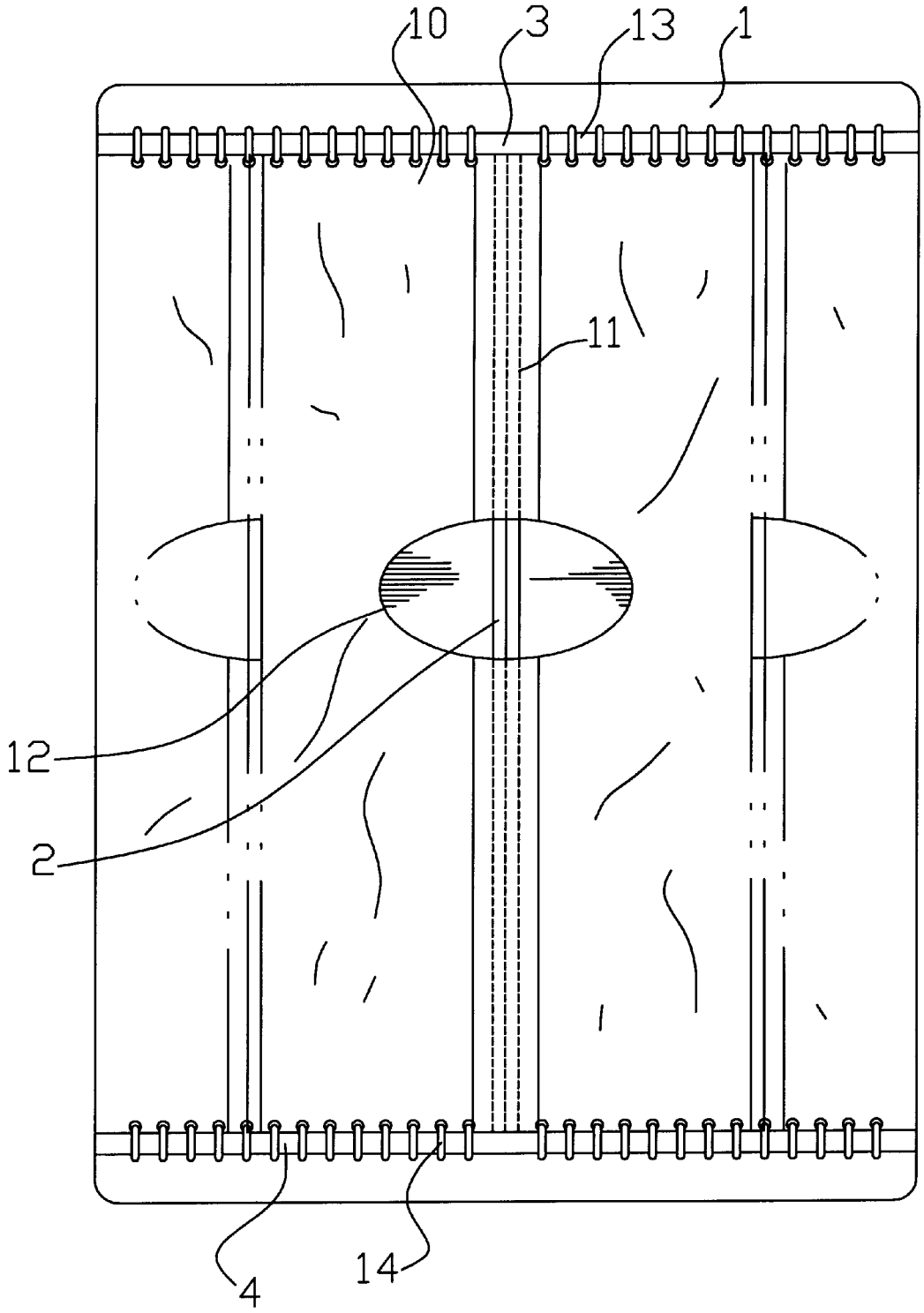
FIG. 2 is a plain view of the present invention showing the moving direction of the folding sliding doors.

Referring to FIGS. 1 and 2, a wardrobe 1 is shown comprising a fixed transverse top rail 3, a fixed transverse bottom rail 4, two collapsible, rectangular sliding folding doors 10 coupled between the top rail 3 and the bottom rail 4. The door folding doors 10 are made of plastic sheet material or soft cloth, each having a horizontal top side edge, a horizontal bottom side edge, a first vertical side edge fixedly connected to the wardrobe 1, a second vertical side edge, a first set of loops 13 and a second set of loops 14 respectively arranged along the horizontal top side edge and the horizontal bottom side edge and hung on the horizontal top rail 3 and the horizontal bottom rail 4, a vertical rod member 2 arranged along the second vertical side edge and fixedly secured thereto by stitches 11, and a hand hole 12 on the middle adjacent to the vertical rod member 2. The hand can be inserted through the hand hole 12 at one sliding folding door 10 to hold the respective vertical rod member 2, and then to pull the respective vertical rod member 2 sideways, enabling the sliding folding door 10 to be moved horizontally along the horizontal top rail 3 and the horizontal bottom rail 4 between the close position and the open position.

Figure 3:
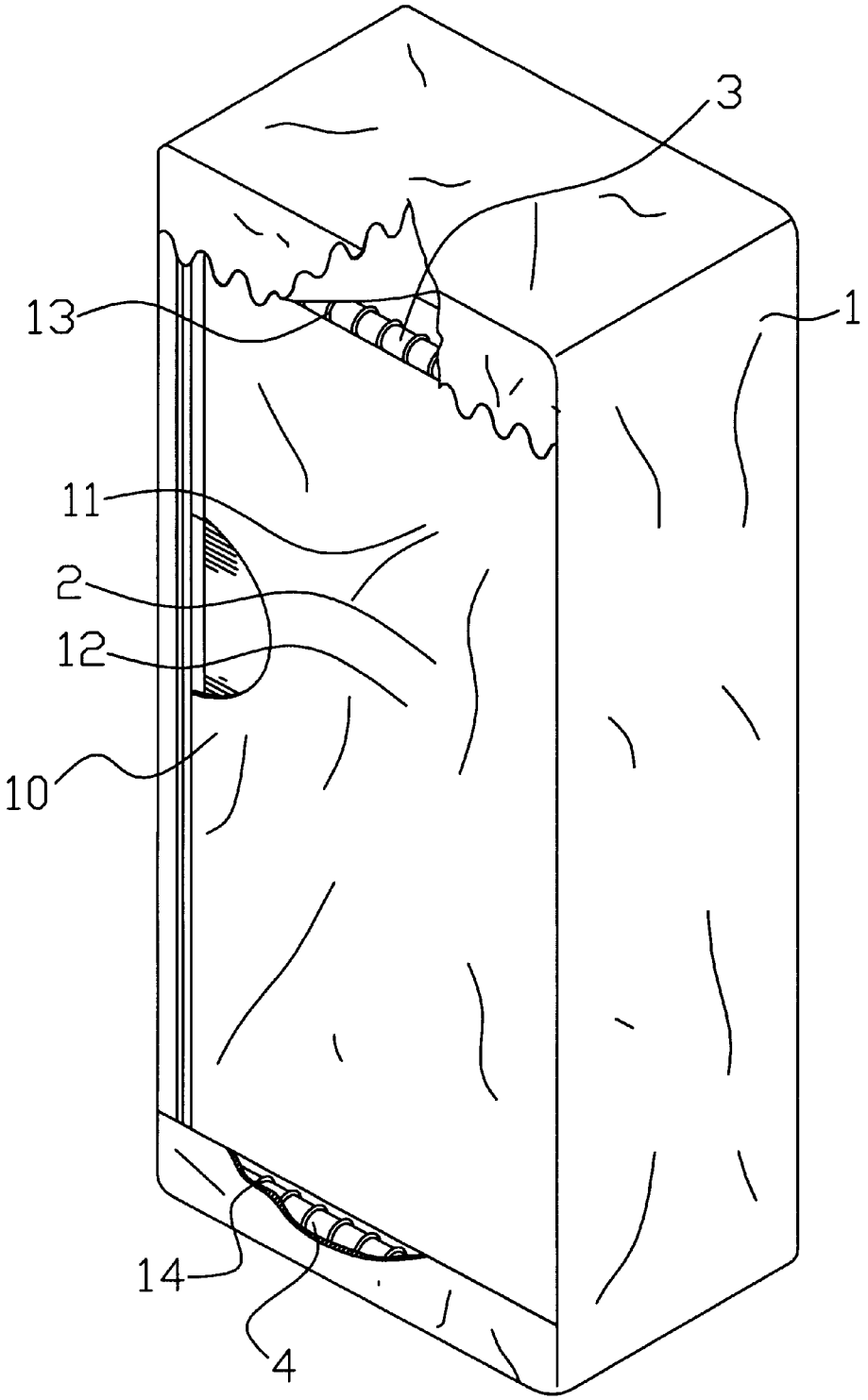
FIG. 3 is a perspective view of a wardrobe with a single sliding folding door according to the present invention.
Figure 4:
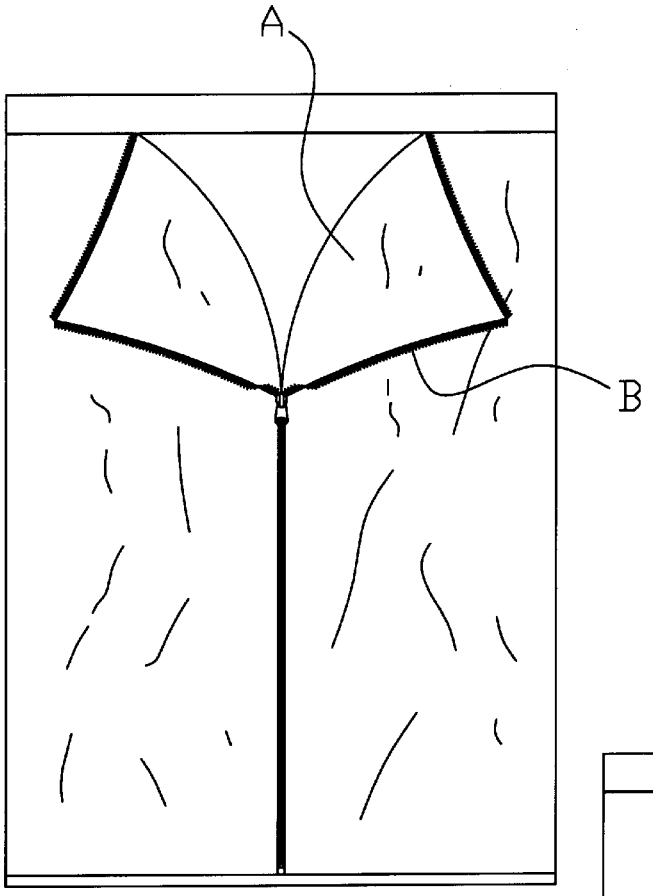
PRIOR ART FIG. 4
FIG. 4 is a plain view of a wardrobe with a double-panel zipper-controlled door structure according to the prior art.
Figure 5:
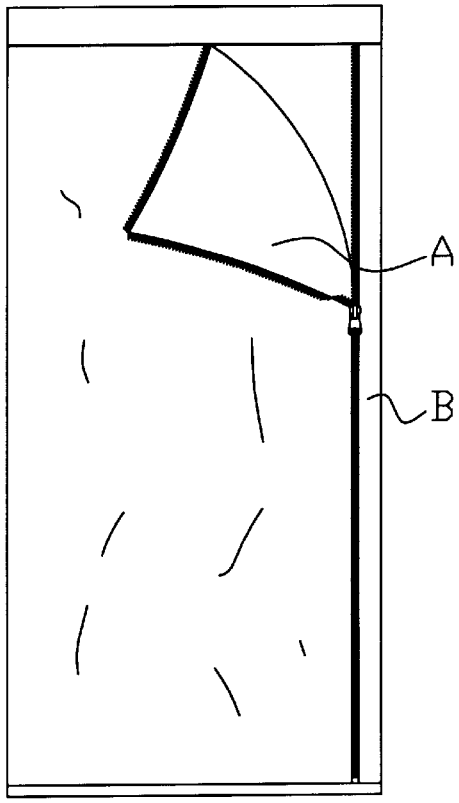
PRIOR ART FIG. 5
FIG. 5 is a plain view of a wardrobe with a single-panel zipper-controlled door structure according to the prior art.

FIG. 3 shows an alternate form of the present invention. According to this alternate form, the wardrobe 1 comprises a fixed horizontal top rail 3, a fixed horizontal bottom rail 4, and a sliding folding door 10 moved horizontally along the horizontal top rail 3 and the horizontal bottom rail 4 between the close position and the open position. The sliding folding door 10 is made of plastic sheet material or soft cloth, having a horizontal top side edge, a horizontal bottom side edge, a first vertical side edge fixedly connected to the wardrobe 1, a second vertical side edge, a first set of loops 13 and a second set of loops 14 respectively arranged along the horizontal top side edge and the horizontal bottom side edge and hung on the horizontal top rail 3 and the horizontal bottom rail 4, a vertical rod member 2 arranged along the second vertical side edge and secured thereto by stitches 11, and a hand hole 12 on the middle adjacent to the vertical rod member 2. By pulling the vertical rod member 2, the sliding folding door 10 can easily be moved along the horizontal top rail 3 and the horizontal bottom rail 4 to close/open the wardrobe 1.

It is to be understood that the drawings are designed for purposes of illustration only, and are not intended for use as a definition of the limits and scope of the invention disclosed.

What the invention claimed is:

1. In a wardrobe having a door structures said door structure comprising:

a fixed horizontal top rail; a fixed horizontal bottom rail; and at least one sliding folding door made of plastic sheet material and having a horizontal top side edge, a horizontal bottom side edge, a first vertical side edge fixedly connected to the wardrobe, a second vertical side edge, a first set of loops arranged along said horizontal top side edge and respectively hung on said horizontal top rail, a second set of loops arranged along said horizontal bottom side edge and respectively hung on said horizontal bottom rail, a vertical rod member located in the sliding folding door arranged along the second vertical side edge, and a hand hole in an intermediate portion of the sliding folding door and adjacent to the vertical rod member revealing a portion of the rod member for grasping purposes.

* * * * *